US006825605B2

(12) United States Patent
Ha et al.

(10) Patent No.: US 6,825,605 B2
(45) Date of Patent: Nov. 30, 2004

(54) NECK OF FUNNEL AND STERN SEALED TO NECK OF CATHODE RAY TUBE

(75) Inventors: Jae-Young Ha, Suwon (KR); Kue-Hong Lee, Suwon (KR); Dong-Won Lim, Euiwang (KR)

(73) Assignee: Samsung SDI CO., Ltd., Suwon-si (KR)

( * ) Notice: Subject to any disclaimer, the term of this patent is extended or adjusted under 35 U.S.C. 154(b) by 37 days.

(21) Appl. No.: 10/023,798

(22) Filed: Dec. 21, 2001

(65) Prior Publication Data

US 2002/0121854 A1 Sep. 5, 2002

(30) Foreign Application Priority Data

Jan. 2, 2001 (KR) ..... 2001-27
Jan. 26, 2001 (KR) ..... 2001-3746

(51) Int. Cl.[7] ..... H01J 31/00; H01J 61/30; H01K 3/22

(52) U.S. Cl. ..... 313/477 HC; 313/477 R; 220/2.1 A; 220/2.2

(58) Field of Search ..... 220/2.1 A, 2.2; 313/477 HC, 477 R

(56) References Cited

U.S. PATENT DOCUMENTS 5,777,430 A * 7/1998 Ueda et al. ..... 313/477 R
5,818,155 A * 10/1998 Kawamura et al. .... 313/318.05
6,078,134 A 6/2000 Nose et al. ..... 313/477 HC
6,462,466 B1 * 10/2002 Sugawara et al. ..... 313/477 R

* cited by examiner

*Primary Examiner*—Nimeshkumar D. Patel
*Assistant Examiner*—Matt Hodges
(74) *Attorney, Agent, or Firm*—Robert E. Bushnell, Esq.

(57) ABSTRACT

A cathode ray tube includes a panel in which a phosphor layer is formed, a funnel connected to the panel, the funnel including a neck having a region for housing an electron gun and a region to which a stem is sealed, and a stem having a plurality of stem pins, each stem pin being supported by each stem mound for applying voltage to each electrode of the electron gun. The inside diameter of the stem sealing region of the neck is greater than that of the electron gun-housing region, the diameter of an inner stem pin circle formed by interior stem pins disposed on the inside of the neck is less than that of an outer stem pin circle formed by exterior stem pins disposed on the outside thereof, a horizontal length between an outer edge of the stem mound and an interior of the neck is in the range greater than or equal to 1.0 mm and less than or equal to 2.0 mm. Furthermore, the cathode ray tube includes a panel in which a phosphor layer is formed, a funnel connected to and tapered from the panel, and a neck connected to the funnel and including an electron gun housing region and a stem sealing region, to which a stem having a plurality of stem pins arranged in an annular shape and passing therethrough for introducing signal voltages from an external circuit is sealed, where D1 is 22.5±0.7 mm and D2 is in the range greater than D1 and less than or equal to 24.0 mm where the outside diameters of the electron gun-housing region and the stem sealing region are D1 and D2, respectively.

14 Claims, 9 Drawing Sheets

NECK OF FUNNEL AND STERN SEALED TO NECK OF CATHODE RAY TUBE

CLAIM OF PRIORITY

This application makes reference to, incorporates the same herein, and claims all benefits accruing under 35 U.S.C. §119 from my applications for CATHODE RAY TUBE earlier filed in the Korean Industrial Property Office on Jan. 2, 2001, and there duly assigned Serial No. 2001-27, and for CATHODE RAY TUBE AND MANUFACTURING METHOD THEREOF earlier filed in the Korean Industrial Property Office on Jan. 26, 2001, and there duly assigned Serial No. 2001-3746 by that Office.

BACKGROUND OF THE INVENTION

1. Field of the Invention

The present invention relates to a cathode ray tube, and more particularly, to a neck of a funnel and a stem sealed to the neck of a cathode ray tube.

2. Description of the Related Art

A cathode ray tube includes a phosphor layer on the inside thereof, a panel to which a shadow mask spaced from the phosphor layer is secured, a funnel having a neck and a cone portion connected to the panel, an electron gun housed in the neck for emitting an electron beam, a deflection yoke fixedly installed around the cone portion, and a stem sealed to one end of the neck for mounting the electron gun.

The cathode ray tube operates as follows. First, if a heater installed on the inside of a cathode of the electron gun generates heat, electrons are emitted from oxide coated on the top of the cathode. Then, the electrons emitted from the cathode pass through each electrode arranged at regular intervals to form the electron beam of the desired characteristics. The formed electron beam is deflected by a magnetic field produced by the deflection yoke, passes through the shadow mask, and collides with the phosphor layer coated on the inside of the panel to light up phosphors, thereby creating a screenful of an image.

To smoothly perform the operation as described above, the interior of the cathode ray tube must maintain a vacuum. To accomplish this, a stem having a plurality of stem pins for supplying voltages to the electron gun and an exhaust pipe for exhaustion is introduced into one end of the neck, and a portion at which the side of a stem flange contacts the inside of the neck is fused and sealed off. The interior of the cathode ray tube is evacuated through the exhaust pipe to a vacuum and the exhaust pipe is then fused and sealed.

The stem includes the stem flange formed in the shape of a flat disk whose diameter is smaller than the inside diameter of a sealing portion, the plurality of stem pins arranged in a round shape to pass through the stem flange for introducing signal voltages from an external circuit, and a plurality of stem mounds convexly built of glass, which is the material of the stem, for holding the plurality of stem pins and preventing the loss of vacuum, and the exhaust pipe formed in the central part of the stem flange for evacuating cathode ray tube to a vacuum. Here, the diameter of an inner stem pin circle of interior stem pins connected to the electrodes of the electron gun is equal to that of exterior stem pins connected to a socket for applying a predetermined voltage of each electrode of the electron gun.

As described above, the exterior stem pins are combined with the sockets installed in a chassis. For example, the stem used in the neck having a diameter of 22.5 mm (millimeters) is fit into a socket for 22.5 mm, and the stem used in the neck having a diameter of 29.1 mm is fit into a socket for 29.1 mm. However, this raises a problem in that a cathode ray tube having a neck of diameter 29.1 mm are not compatible with that having a neck of a diameter 22.5 mm since chassis for 29.1 mm has been chiefly manufactured in a market for monitors of 15 or more inches (diagonal measurement of screen).

Recently, an electric potential applied to a focusing electrode of an electron gun tends to increase due to a flat panel of a cathode ray tube and increased dynamic focusing modulation. Furthermore, current must be applied to coils of a deflection yoke to deflect electron beams emitted from the electron gun in a cathode ray tube. Since a smaller amount of current is consumed as the diameter of a neck decreases, the diameter of the neck tends to be less for low power consumption.

However, high electric potential and small diameter of a neck results in large spherical aberrations due to a decreased size of electrodes of an electron gun. To prevent this, the number of electrodes of an electron gun should be increased. Since the increased number of electrodes increases the number of stem pins accordingly, problems associated with a breakdown voltage may occur. To solve the breakdown voltage problems, one empty pin may be inserted on either side of a high voltage stem pin. However, since insertion of empty pins may result in the increased number of stem pins, a stem having a large stem pin circle is required.

Furthermore, to solve the breakdown voltage problems, the diameter of a neck may be made larger, and the diameter of a stem flange may be made larger to seal it to one end of the neck. However, the large diameter of the neck results in high power consumption and sealing the stem flange to the neck end may require an extra device and drop a yield rate.

It is more difficult to fuse and seal the stem having a large stem pin circle to a low deflection cathode ray tube having a narrow neck of a diameter 22.5 mm than to a cathode ray tube having a neck of a diameter 29.1 mm presently widely used. Furthermore, if a stem mount is formed very close to a connecting portion where the stem flange is fused and sealed to the end of the neck, cracks may occur easily at the connecting portion of the stem flange and the neck.

A neck of a cathode ray tube is disclosed in U.S. Pat. No. 6,078,134 issued to Nose et al. for Narrow-neck CRT having a Large Stem Pin Circle.

SUMMARY OF THE INVENTION

It is therefore an object of the present invention to provide a cathode ray tube having a stem compatible with a cathode ray tube having a neck of a different diameter, which simplifies a fabrication process and increases a yield rate by sealing the compatible stem to a neck with an existing sealing device.

It is another object of the present invention to provide a cathode ray tube having a stem-sealing region of a neck, where the inside diameter of the sealing region is increased so that it is easier to fuse and seal a stem having a large stem pin circle to the narrow neck of the cathode ray tube with low deflection.

Accordingly, to achieve the above and other objects, the present invention provides a cathode ray tube. The cathode ray tube includes a panel in which a phosphor layer is formed, a funnel connected to the panel, the funnel including a neck having a region for housing an electron gun and a region to which a stem is sealed, and a stem having a plurality of stem pins, each stem pin being supported by each stem mound for applying voltage to each electrode of the electron gun. The inside diameter of the stem sealing region of the neck is greater than that of the electron gun-housing region, the diameter of an inner stem pin circle formed by interior stem pins disposed on the inside of the neck is less than that of an outer stem pin circle formed by exterior stem pins disposed on the outside thereof, a horizontal length between an outer edge of the stem mound and an interior of the neck is in the range greater than or equal to 1.0 mm and less than or equal to 2.0 mm.

In another embodiment, a cathode ray tube includes a panel in which a phosphor layer is formed, a funnel connected to and tapered from the panel, and a neck connected to the funnel and including an electron gun-housing region and a stem sealing region, to which a stem having a plurality of stem pins arranged in an annular shape and passing therethrough for introducing signal voltages from an external circuit is sealed, wherein D1 is 22.5±0.7 mm and D2 is in the range greater than D1 and less than or equal to 24.0 mm where the outside diameters of the electron gun-housing region and the stem sealing region are D1 and D2, respectively.

As described above, the cathode ray tube according to an embodiment of the present invention forms an outer stem pin circle greater than an inner stem pin circle, thereby achieving compatibility with cathode ray tubes having a neck of a different diameter. The stem is sealed to the inside of the neck by making the inside diameter of the sealing region of the neck larger than that of an electron gun-housing region, thereby increasing a yield rate without the need for a special device which is otherwise required for sealing a stem to one end of a neck. Furthermore, the stem is sealed at the stem-sealing region of the neck, thereby removing glass residues or foreign material and increasing a breakdown voltage.

The cathode ray tube according to another embodiment of this invention increases the outside diameter of a stem-sealing region of a narrow neck so that it is easier to fuse and seal the stem having a large stem pin circle to the narrow neck of the low deflection cathode ray tube. Furthermore, the cathode ray tube increases a distance between a stem mound on a stem flange and a connecting portion of the neck, thereby preventing occurrences of crack at the connecting portion.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
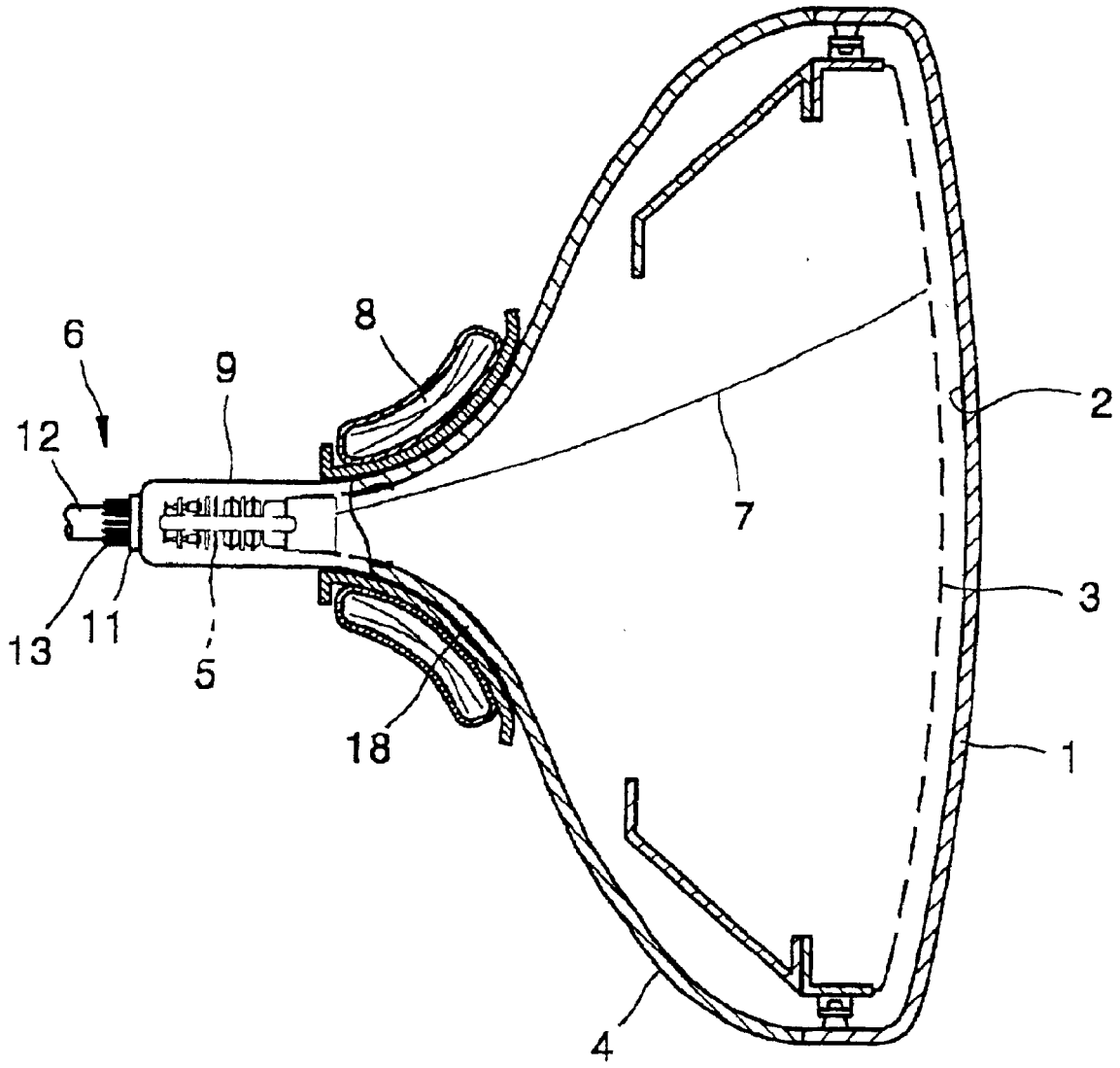
FIG. 1 is a schematic cross-section showing the configuration of a conventional cathode ray tube.
Figure 2:
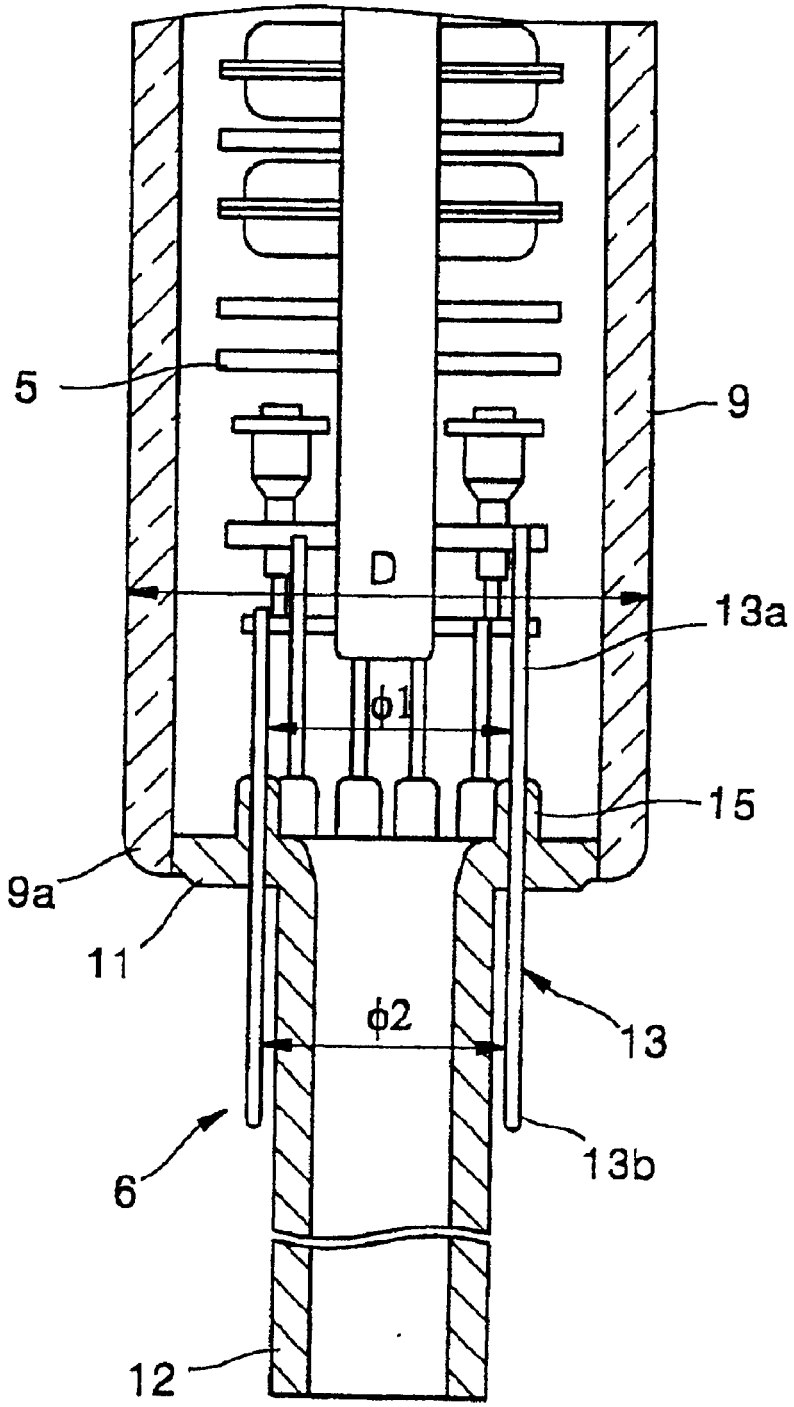
FIG. 2 is a partial cross-section showing a state in which a stem has been sealed to a neck in a conventional cathode ray tube.

Turning now to the drawings, referring to FIGS. 1 and 2, an earlier cathode ray tube includes a phosphor layer 2 on the inside of the cathode ray tube, a panel 1 to which a shadow mask 3 spaced from the phosphor layer 2 is fixed, a funnel 4 having a neck 9 and a cone portion 18 connected to the panel 1, an electron gun 5 housed in the neck 9 for emitting an electron beam 7, a deflection yoke 8 fixedly installed around the cone portion 18, and a stem sealed to one end of the neck 9 for mounting the electron gun 5.

The cathode ray tube operates as follows. First, if a heater (not shown) installed on the inside of a cathode of the electron gun 5 generates heat, electrons are emitted from oxide coated on the top of the cathode. Then, the electrons emitted from the cathode pass through each electrode arranged at regular intervals to form the electron beam 7 of the desired characteristics. The thus-formed electron beam 7 is deflected by a magnetic field produced by the deflection yoke 8, passes through the shadow mask 3, and collides with the phosphor layer 2 coated on the inside of the panel 1 to light up phosphors, thereby creating a screen full of an image.

To smoothly perform the operation as described above, the interior of the cathode ray tube must maintain a vacuum. To accomplish this, as shown in FIG. 2, a stem 6 having a plurality of stem pins 13 for supplying voltages to the electron gun 5 and an exhaust pipe 12 for exhaustion is 14 introduced into one end of the neck 9, and a portion at which the side of a stem flange 11 contacts the inside of the neck 9 is fused and sealed off. The interior of the cathode ray tube is evacuated through the exhaust pipe 12 to a vacuum and the exhaust pipe 12 is then fused and sealed.

Figure 3A:
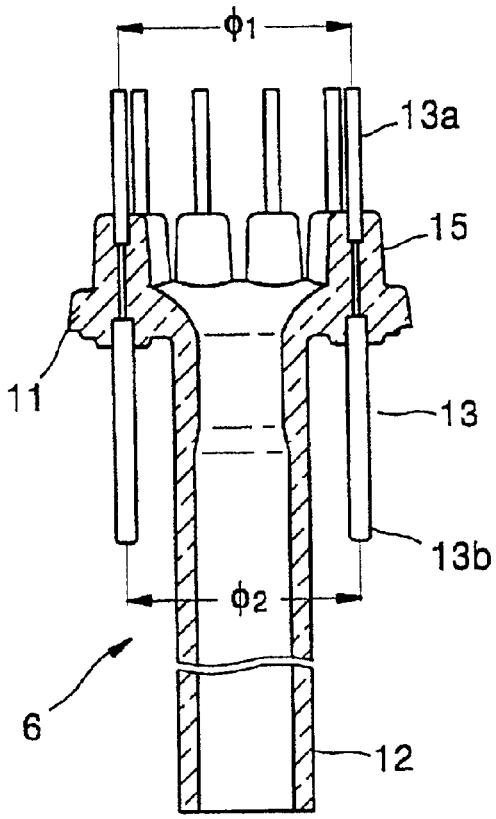
FIG. 3A is a cross-section showing the configuration of a conventional stem.
Figure 3B:
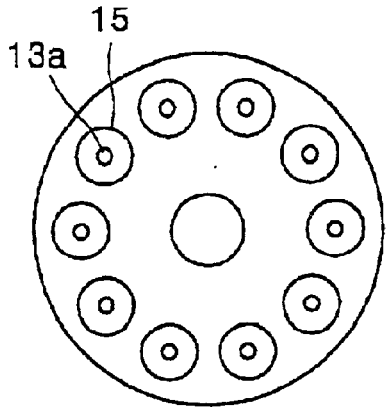
FIG. 3B is a top view showing the configuration of a conventional stem.
Figure 3C:
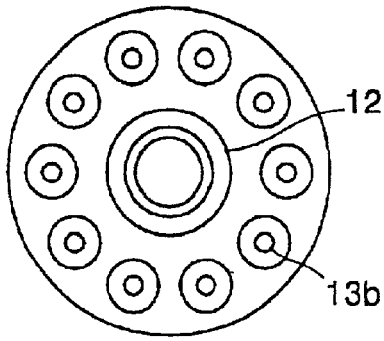
FIG. 3C is a bottom view showing the configuration of a conventional stem.

Referring to FIGS. 3A through 3C, the stem 6 includes the stem flange 11 formed in the shape of a flat disk whose diameter is smaller than the inside diameter of a sealing portion (9*a* of FIG. 2), the plurality of stem pins 13 arranged in a round shape to pass through the stem flange 11 for introducing signal voltages from an external circuit, and a plurality of stem mounds 15 convexly built of glass, which is the material of the stem 12, for holding the plurality of stem pins 13 and preventing the loss of vacuum, and the exhaust pipe 12 formed in the central part of the stem flange 11 for evacuating cathode ray tube to a vacuum. Here, the diameter F1 of an inner stem pin circle of interior stem pins 13*a* connected to the electrodes of the electron gun 5 is equal to that F2 of exterior stem pins 13*b* connected to a socket (not shown) for applying a predetermined voltage of each electrode of the electron gun 5.

As described above, the exterior stem pins 13*b* are combined with the sockets installed in a chassis (not shown). For example, the stem 6 used in the neck 9 having a diameter of 22.5 mm (millimeters) is fit into a socket for 22.5 mm, and the stem 6 used in the neck 9 having a diameter of 29.1 mm is fit into a socket for 29.1 mm. However, this raises a problem in that a cathode ray tube having a neck of diameter 29.1 mm are not compatible with that having a neck of a diameter 22.5 mm since chassis for 29.1 mm has been chiefly manufactured in a market for monitors of 15 or more inches.

Recently, an electric potential applied to a focusing electrode of an electron gun tends to increase due to a flat panel of a cathode ray tube and increased dynamic focusing modulation. Furthermore, current must be applied to coils of a deflection yoke to deflect electron beams emitted from the electron gun in a cathode ray tube. Since a smaller amount of current is consumed as the diameter of a neck decreases, the diameter of the neck tends to be less for low power consumption.

However, high electric potential and small diameter of a neck results in large spherical aberrations due to a decreased size of electrodes of an electron gun. To prevent this, the number of electrodes of an electron gun should be increased. Since the increased number of electrodes increases the number of stem pins accordingly, problems associated with a breakdown voltage may occur. To solve the breakdown voltage problems, one empty pin may be inserted on either side of a high voltage stem pin. However, since insertion of empty pins may result in the increased number of stem pins, a stem having a large stem pin circle is required.

Furthermore, to solve the breakdown voltage problems, the diameter of a neck may be made larger, and the diameter of a stem flange may be made larger to seal it to one end of the neck. However, the large diameter of the neck results in high power consumption and sealing the stem flange to the neck end may require an extra device and drop a yield rate.

It is more difficult to fuse and seal the stem having a large stem pin circle to a low deflection cathode ray tube having a narrow neck of a diameter 22.5 mm than to a cathode ray tube having a neck of a diameter 29.1 mm presently widely used. Furthermore, if a stem mount is formed very close to a connecting portion where the stem flange is fused and sealed to the end of the neck, cracks may occur easily at the connecting portion of the stem flange and the neck.

Figure 4:
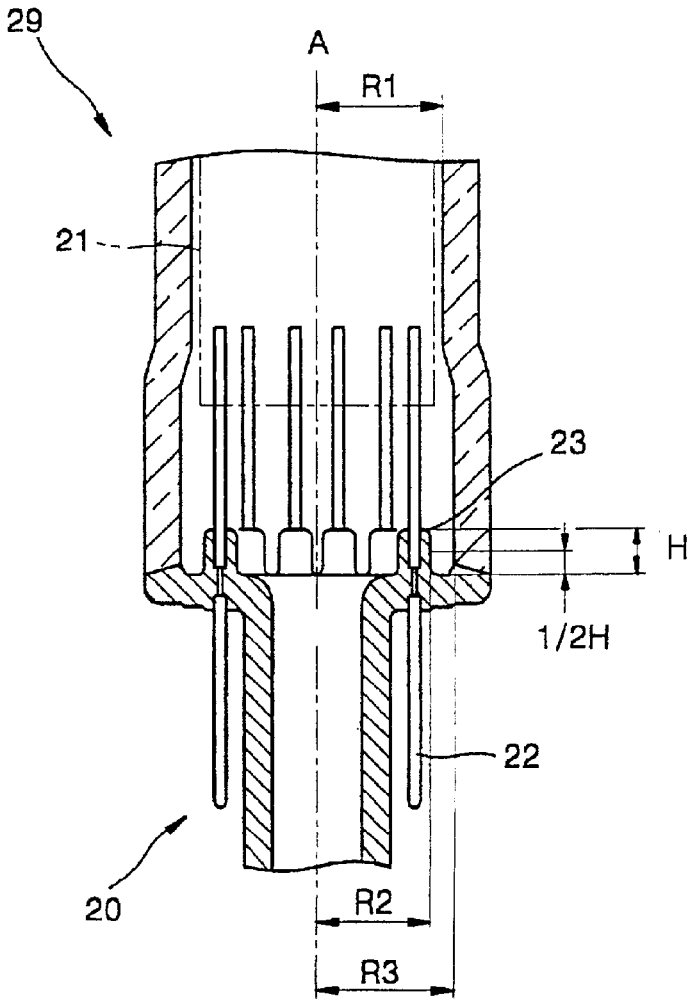
FIG. 4 (PRIOR ART)
FIG. 4 is a cross-section showing a state in which a stem has been sealed to a neck in another conventional cathode ray tube.

A neck of a cathode ray tube is disclosed in U.S. Pat. No. 6,078,134 issued to Nose et al. for Narrow-neck CRT having a Large Stem Pin Circle. Referring to FIG. 4, a neck 29 of a cathode ray tube includes stem mounds 23 formed integrally with a stem 20 by raising a glassy material around a base of each of stem pins on an electron-gun-supporting-side thereof. A first distance R1 and a second distance R2 satisfy a relationship, $0<R1-R2<2.1$ mm, and a third distance R3 is not less than the first distance R1 in a region of the neck 29 facing the stem mound 23 except in the vicinity of the fusing and sealing region of the neck 29 and the stem 20. Here, the first distance R1 is a distance between a central axis A of the neck 29 and an inner wall in a region of the neck 29 accommodating the major portion of an electron gun 21, the second distance R2 is a distance between the central axis A and an outside edge of the stem mound 23 as measured at half an axial height H of the stem mound 23, and the third distance R3 is a distance between an inner wall of the neck 29 and the central axis A.

Figure 5A:
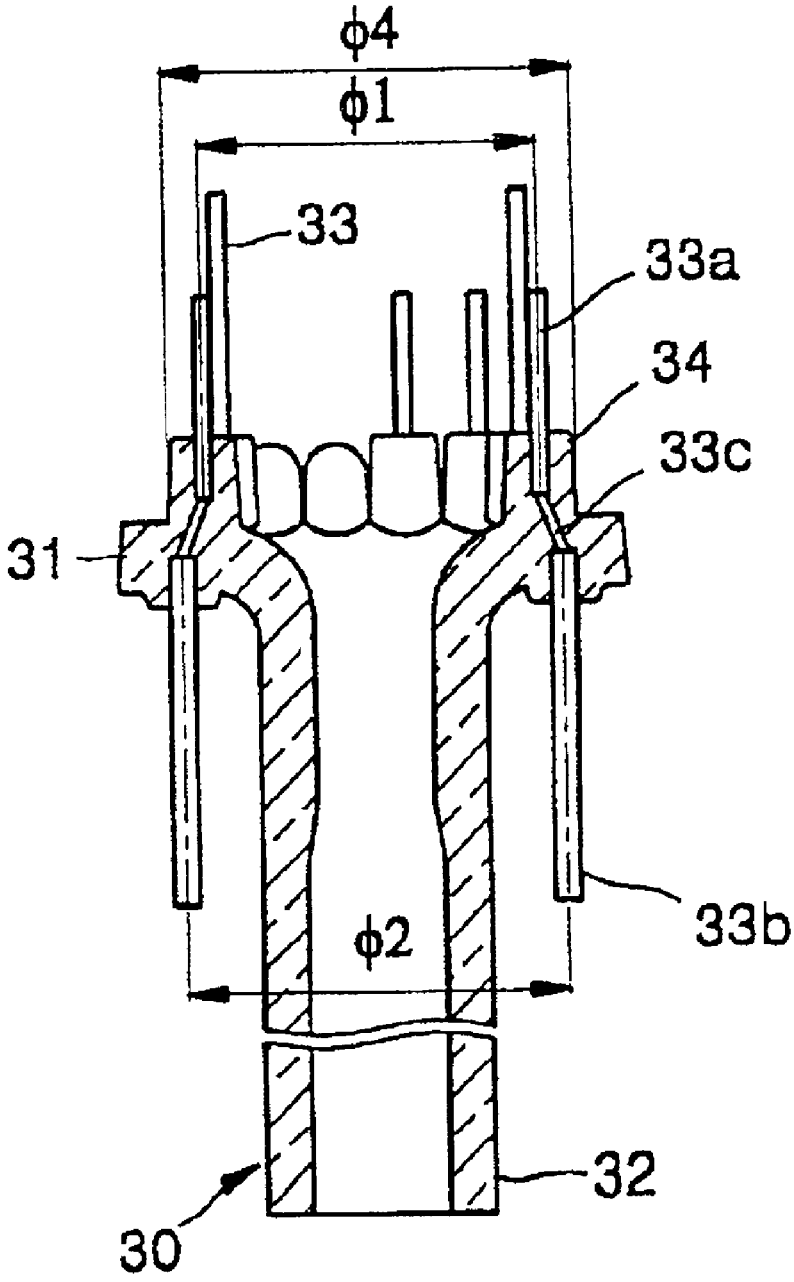
FIG. 5A is a cross-section view showing the configuration of a stem in a cathode ray tube according to a first embodiment of the present invention.
Figure 5B:
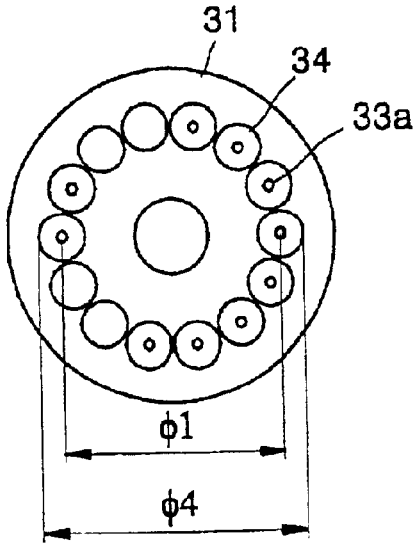
FIG. 5B is a top view showing the configuration of a stem in a cathode ray tube according to a first embodiment of the present invention.
Figure 5C:
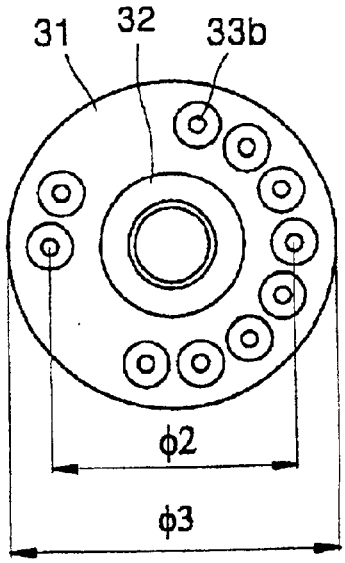
FIG. 5C is a bottom view showing the configuration of a stem in a cathode ray tube according to a first embodiment of the present invention.

Referring to FIGS. 5A through 5C, a stem 30 of a cathode ray tube according to a first embodiment of the present invention includes a stem flange 31, an exhaust pipe 32 formed in a central part of the stem flange 31, a plurality of stem pins 33, and a plurality of stem mounds 34 for holding the plurality of stem pins 33. The exhaust pipe 32 is formed so that the interior of the cathode ray tube maintains a vacuum. Each of the stem pins 33 located within a neck (39 of FIG. 6A) is connected to each electrode of an electron gun (not shown). Each of the stem pins 33 includes an interior stem pin 33*a* having an inner stem pin circle of a predetermined diameter Φ1, arranged around the periphery of the stem flange 31 at regular intervals, an intermediate portion 33*c* buried in the stem flange 31 and bent outward for connecting the interior stem pin 33*a* to an exterior stem pin 33*b*, and the exterior stem pin 33*b* having an outer stem pin circle of a diameter Φ2 greater than the diameter Φ1. The exterior stem pin 33*b* has one end connected to a socket (not shown) for applying a predetermined voltage to each electrode of the electron gun and the other end connected the intermediate portion 33*c*. It is preferable that the diameter Φ2 of the outer stem pin circle is 15.24 mm in order to achieve compatibility with a chassis for 29.1 mm. Furthermore, it is preferable that the diameter Φ1 of the inner stem pin circle is 13.5 mm in order to seal the stem 30 to a mini neck having a diameter of 22.5 mm. This is because the distance between the stem pins 33 and the distance between each of the stem pins 33 and the inside part of the neck 39 are appropriately secured to prevent reduction in breakdown voltage and occurrences of crack in the stem pin 33.

To increase insulation characteristics and support the interior stem pins 33*a*, the stem mounds 34 are integrally formed with the stem flange 31 on the stem flange 31 around the periphery thereof. Preferably, a diameter Φ4 of a circle formed by the stem mounds 34 around the periphery of the stem flange 31 is controlled to be 16.4 mm so that the distance between the diameter Φ4 and the inside diameter Φ6 of a stem-sealing region 41 of the neck 39, which will be described below, is not less than 1 mm in order to facilitate sealing. Furthermore, it is preferable that the diameter Φ3 of the stem flange 31 is 20.3 mm and the side of the stem flange 31 is sloped in the same direction as the sealing region 41, which will be described below, thereby facilitating the sealing process.

Figure 6A:
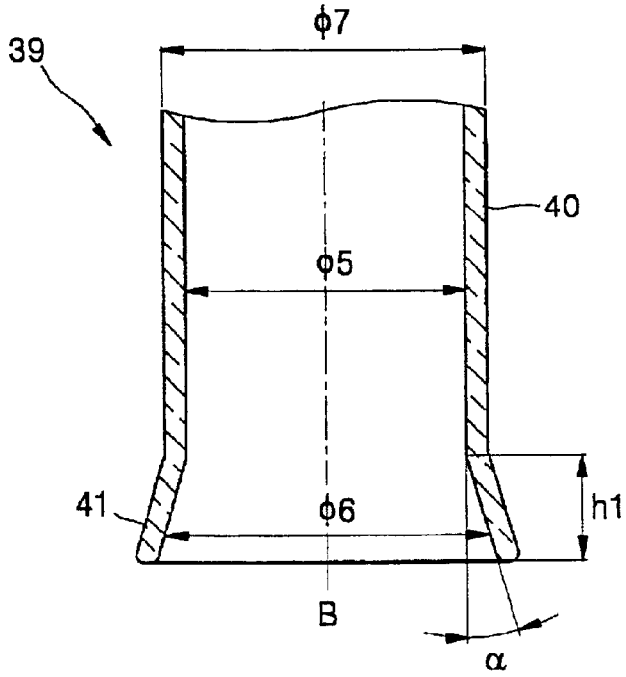
FIG. 6A is a cross-section of the neck before sealing the stem of FIG. 5A to the neck in the cathode ray tube according to the first embodiment of the present invention.
Figure 6B:
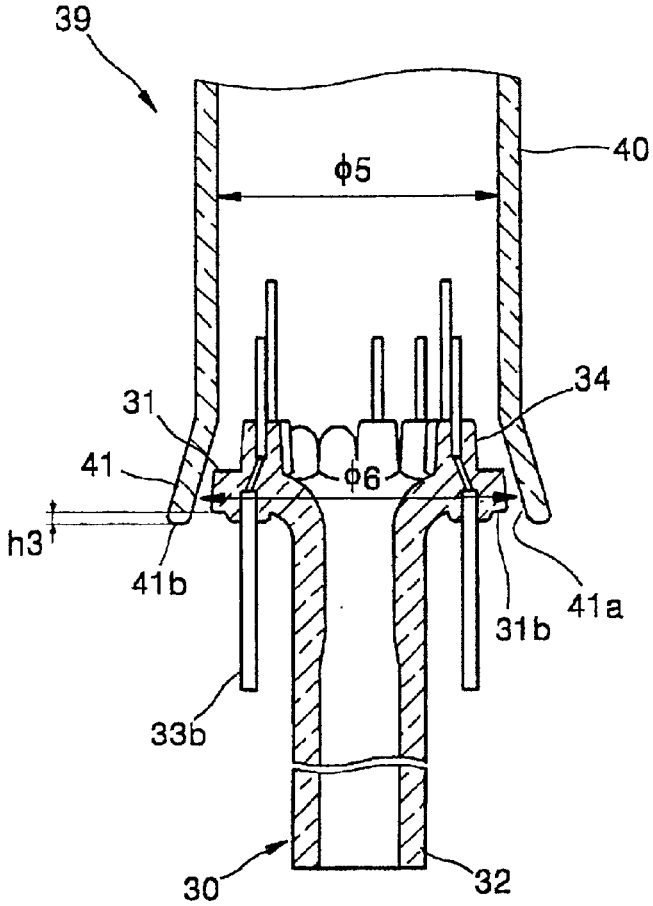
FIG. 6B is a cross-section showing a state in which the stem and the neck have been positioned before sealing the stem to the neck in the cathode ray tube according to the first embodiment of the present invention.
Figure 6C:
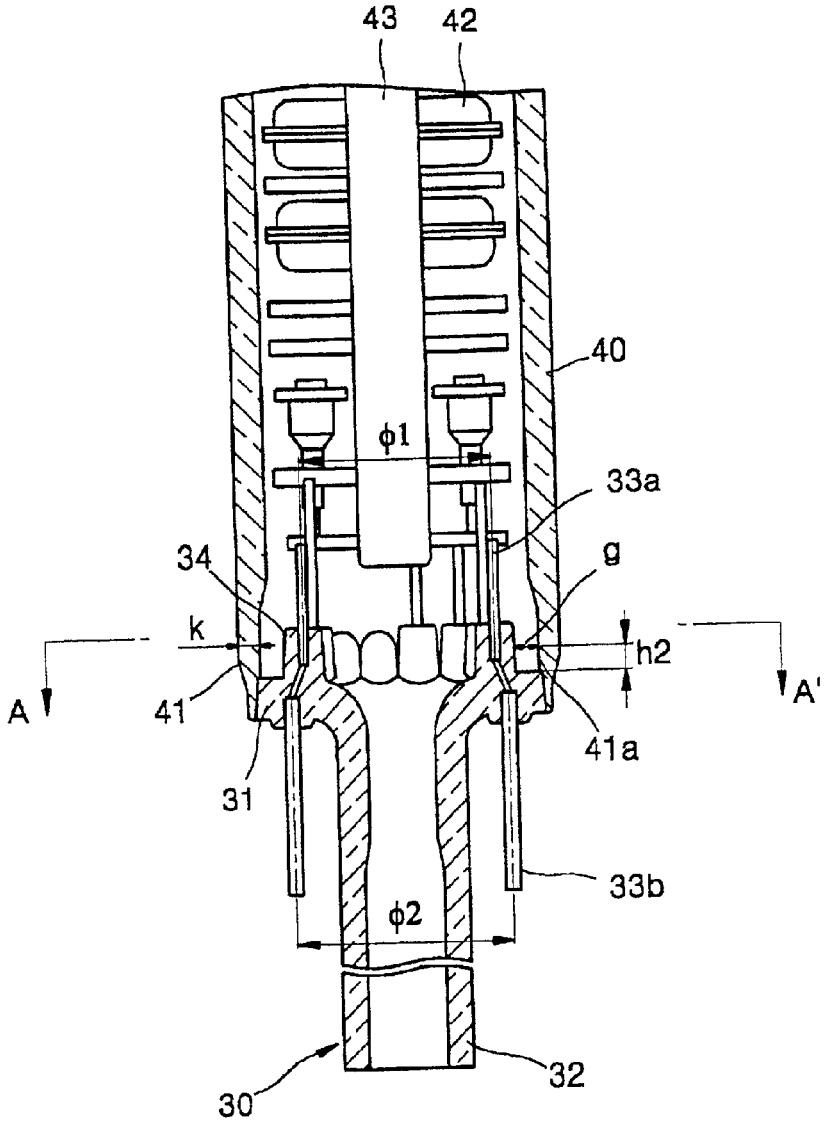
FIG. 6C is a partial cross-section showing a state in which the stem of FIG. 5A has been sealed to the neck in the cathode ray tube according to the first embodiment of the present invention.
Figure 6D:
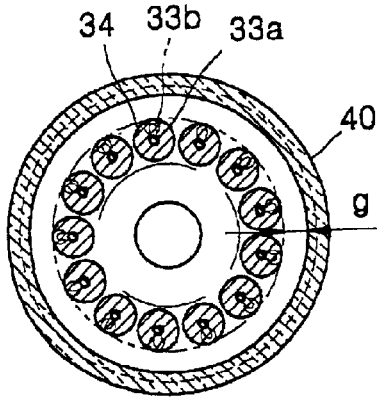
FIG. 6D is a cross-section taken along line A-A' of FIG. 6C.

FIG. 6A is a cross-section of the neck 39 before the stem of FIG. 5A is combined with the neck 39 in the cathode ray tube according to the first embodiment of the present invention. FIG. 6B is a cross-section showing a state in which the neck 39 and the stem 30 are positioned before sealing for combining the stem 30 of FIG. 5A to the neck 39. FIG. 6C is a cross-section showing a state in which the stem 30 of FIG. 5A has been sealed to the neck 39. FIG. 6D is a cross-section taken along line A-A' of FIG. 6C.

Referring to FIGS. 6A through 6D, the neck 39 includes an electron gun housing region 40 for accommodating a major portion of the electron gun, and the stem-sealing region 41 for housing the interior stem pins 33*a* and the stem mounds 34 and sealing the stem 30. The outside diameter Φ7 of the electron gun housing region 40 of the neck 39 is preferably 22.5±0.7 mm. The stem-sealing region 41 of the neck 39 is flared out at a predetermined angle α so that the inside diameter of the stem-sealing region 41 is greater than that Φ5 of the electron gun housing region 40. Preferably, the predetermined angle α is 20 degrees, and a vertical length h1 of the stem-sealing region 41 along an axis B is 8 mm for the difference between the diameter Φ4 of the stem mound circle and the inside diameter Φ6 of the stem-sealing region 41 to be not less than 1 mm.

Referring to FIG. 6B, the stem 30 is introduced and positioned into the stem-sealing region 41 so that a vertical distance h3 between an end 41*b* of the stem-sealing region 41 and a bottom 31*b* of the stem flange 31 is in the range greater than or equal to 0.3 mm and less than or equal to 1.5 mm, after fusing, the remaining part of the stem flange having a flare shape can be cut, thereby protecting against a poor sealing process. Also, the stem 30 is pulled toward the exterior stem pin 33*b* when fusing and sealing the stem-sealing region 41 to make the thickness k (See FIG. 6C) of the stem-sealing region 41 less, so that a horizontal distance g (See FIG. 6C) between an outer edge of the stem mound 34 and an interior 41*a* of the stem-sealing region 41 is in the range greater than or equal to 1.0 mm and less than or equal to 2.0 mm.

Referring to FIG. 6C, a portion at which the stem flange 31 contacts an end of the stem-sealing portion 41 is fused and sealed. Preferably, the sealing is performed such that the horizontal distance g between the outer edge of the stem mound 34 and the interior 41*a* of the stem-sealing region 41 measured at half a height h2 of the stem mound 34 is in the range greater than or equal to 1.0 mm and less than or equal to 2.0 mm. This is because an appropriate distance such as the horizontal distance g is provided between the stem mound 34 and the interior 41*a* of the stem-sealing region 41 to prevent occurrences of crack in the stem pin 33 during sealing and increase a breakdown voltage during vacuum processing.

A bead glass 43 is installed along electrodes 42 of the electron gun. The bead glass 43 provides insulating support for the electrodes 42 and also support for cathodes. The bead glass 43 can firmly hold the electrodes 42 at predetermined spacings and positions. The number of stem pins 33 is not less than nine. The stem pins supply voltages to cathodes and electrodes. Three stem pins are connected to three respective cathodes. Three other stem pins are used to cutoff the voltage supply to three respective cathodes. Finally, three other stem pins are connected to at least three respective electrodes.

Figure 7:
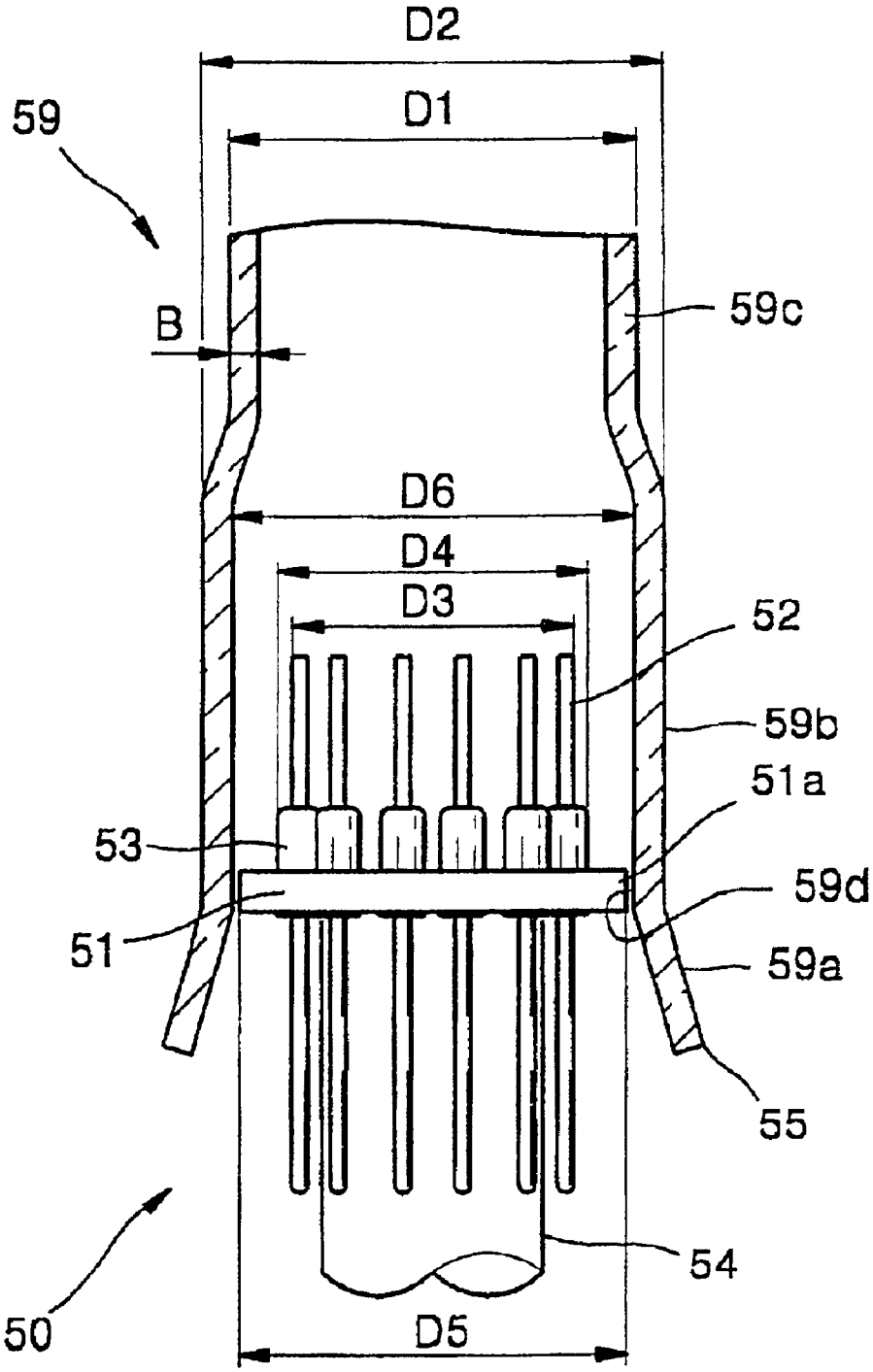
FIG. 7 is a partial cross-section showing a state in which a stem has been connected to a neck in a cathode ray tube according to a second embodiment of the present invention.

FIG. 7 shows a state in which a stem has been sealed to a neck in a cathode ray tube according to a second embodiment of the present invention. Referring to FIG. 7, a neck 59 includes an electron gun housing region 59*c* for accommodating an electron gun (not shown) and a stem-sealing region 59*b* for sealing a stem 50. The outside diameter of the electron gun-housing region 59*c* is made different from that of the stem-sealing region 59*b* in order to seal the stem 50 having a large stem pin circle to the low deflection cathode ray tube having the narrow neck 59. Assuming that the outside diameters of the electron gun housing region 59*c* and the stem-sealing region 59*b* are D1 and D2, respectively, D1 is 22.5±0.7 and D2 is in the range greater than D1 and less than or equal to 24.0 mm (D1<D2≦24.0 mm).

The stem 50 sealed to the neck 59 basically includes a stem flange 51, an exhaust pipe 54 formed in a central part of the stem flange 51, a plurality of stem pins 52, and a plurality of stem mounds 53 for the plurality of stem pins 52. The exhaust pipe 54 is formed such that the interior of the cathode ray tube maintains a vacuum. The stem 50 is typically made of a glassy material, and a flare portion 55 shaped so that the glassy material is flared out at a predetermined angle is formed at an open end 59*a* of the neck 59 to which the stem 50 is sealed. This facilitates introduction of the stem 50 into the stem-sealing region 59*b* of the neck 59. Also, this makes it easier to fuse an edge 51*a* of the stem flange 51 to a connecting portion 59*d* of the neck 59. The flare portion 55 is cut after fusing.

In the stem pin 52, the diameter of a stem pin circle formed by interior stem pins 52*a* disposed on the inside of the neck 59 is equal to that formed by exterior stem pins 52*b* disposed on the outside thereof and connected to a socket (not shown). Where the diameters of the stem pin circles are D3, a diameter of a stem mound circle formed along outer edges of the stem mounds 53 is D4, and the diameter of the stem flange 51 is D5, and the inside diameter of the stem-sealing region 59*b* is D6, Table 1 shows mechanical data of the neck 59 having a small diameter and the stem having a large diameter used in the cathode ray tube according to the second embodiment of the present invention compared to those of conventional cathode ray tubes.

TABLE 1

| | Prior art 1 | Prior art 2 | Second embodiment of present invention | | |
|---|---|---|---|---|---|
| D3 (mm) | 12.0 | 12.0 | 13.4 | 14.0 | 14.7 |
| D4 (mm) | 14.8 | 14.8 | 16.2 | 16.8 | 17.5 |
| D5 (mm) | 16.8 | 16.8 | 18.2 | 18.8 | 18.5 |
| D6 (mm) | 17.2 | 18.4 | 20.0 | 20.0 | 20.0 |
| D5-D4 (mm) | 2.0 | 2.0 | 2.0 | 2.0 | 1.0 |
| D6-D5 (mm) | 0.4 | 1.6 | 1.8 | 1.2 | 1.5 |
| D6-D4 (mm) | 2.4 | 3.6 | 3.8 | 3.2 | 2.5 |

As evident from Table 1, it is possible to increase the inside diameter D6 of the stem-sealing region 59*b* of the neck 59 to 20.0 mm or less when the diameters D3 of the stem pin circle in the cathode ray tube according to the second embodiment of the present invention are increased to 13.4, 14.0, and 14.7 mm, respectively. This is because D5–D4 must be in the range greater than or equal to 1.0 mm and less than or equal to 2.0 mm, i.e., 1.0 mm≦D5–D4≦2.0 mm, and D6–D4 must be greater than 2.0 mm. Thus, a distance between the stem mound 53 on the stem flange 51 and the inside diameter D6 of the stem-sealing portion 59*b* of the neck 59 is provided sufficient to prevent occurrences of crack during sealing and increase a breakdown voltage during vacuum processing. Thus, considering that the thickness B of the glassy material of the neck 59 is about 2 mm, it is possible to increase the outside diameter D2 of the stem-sealing region 59*b* to 24.0 mm or less.

While this invention has been particularly shown and described with reference to a preferred embodiment thereof, it will be understood by those skilled in the art that various changes in form and details may be made therein without departing from the spirit and scope of the invention as defined by the appended claims.

What is claimed is:

1. A cathode ray tube, comprising:

a panel including a phosphor layer being formed;

a funnel connected to said panel, said funnel including a neck having a region for housing an electron gun and a region including a stem being sealed; and said stem having a plurality of stem pins, each stem pin being supported by each stem mound for applying voltage to each electrode of the electron gun, the inside diameter of said stem sealing region of said neck being greater than the electron gun housing region, the diameter of an inner stem pin circle formed by interior stem pins disposed on the inside of said neck being less than an outer stem pin circle formed by exterior stem pins disposed on the outside of said neck, a horizontal length between an outer edge of said stem mound and an interior of said neck being in the range greater than or equal to 1.0 mm and less than or equal to 2.0 mm.

2. The cathode ray tube of claim 1, with the outside diameter of the electron gun housing region of the neck being from 21.8 millimeters to 23.2 millimeters.

3. The cathode ray tube of claim 1, with the number of stem pins being at least nine.

4. The cathode ray tube of claim 2, with the number of stem pins being at least nine.

5. The cathode ray tube of claim 1, with the stem sealing region of the neck being flared out from the electron gun-housing region of the neck at a predetermined angle.

6. A cathode ray tube, comprising:

a panel including a phosphor layer being formed;

a funnel connected to and tapered from said panel; and a neck connected to said funnel and including an electron gun housing region and a stem sealing region, to which a stem including a plurality of stem pins arranged in an annular shape and passing therethrough for introducing signal voltages from an external circuit being sealed, an outside diameter of the electron gun housing region being in the range from 21.8 to 23.2 and the stem sealing region being in the range greater than the outside diameter of the electron gun housing region and less than or equal to 24.0 mm.

7. The cathode ray tube of claim 6, further comprising a flare portion being disposed at one end of said neck.

8. The cathode ray tube of claim 6, with said stem being introduced into and sealed to the stem sealing region of said neck.

9. The cathode ray tube of claim 7, with said stem being introduced into and sealed to the stem sealing region of said neck.

10. A cathode ray tube, comprising:

a funnel comprising a neck including a region for housing an electron gun and a region to which a stem is sealed; and said stem having a plurality of stem pins, each stem pin being supported by each stem mound for applying voltage to each electrode of the electron gun, the inside diameter of the stem sealing region of the neck being greater than the electron gun housing region, the diameter of an inner stem pin circle formed by interior stem pins disposed on the inside of the neck being less than an outer stem pin circle formed by exterior stem pins disposed on the outside of the neck, a horizontal length between an outer edge of the stem mound and an interior of the neck being in the range greater than or equal to 1.0 mm and less than or equal to 2.0 mm.

11. The cathode ray tube of claim 10, with the outside diameter of the electron gun-housing region of the neck being from 21.8 millimeters to 23.2 millimeters.

12. The cathode ray tube of claim 10, with the number of stem pins being at least nine.

13. The cathode ray tube of claim 11, with the number of stem pins being at least nine.

14. The cathode ray tube of claim 10, with the stem sealing region of the neck being flared out from the electron gun-housing region of the neck at a predetermined angle.

* * * * *